US008161751B2

(12) United States Patent
Hall

(10) Patent No.: US 8,161,751 B2
(45) Date of Patent: Apr. 24, 2012

(54) HIGH VOLUME FUEL NOZZLES FOR A TURBINE ENGINE

(75) Inventor: Joel Hall, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 419 days.

(21) Appl. No.: 12/433,236

(22) Filed: Apr. 30, 2009

(65) Prior Publication Data

US 2010/0275604 A1 Nov. 4, 2010

(51) Int. Cl.
*F02C 1/00* (2006.01)

(52) U.S. Cl. ..... 60/742; 60/748

(58) Field of Classification Search ..... 60/737, 60/740, 742, 746–748; 239/399, 463, 491, 239/494, 497, 533.2
See application file for complete search history.

(56) References Cited

U.S. PATENT DOCUMENTS 3,039,701 A * 6/1962 Carlisle ..... 239/419
3,477,647 A * 11/1969 Sharpe et al. ..... 239/468
3,763,650 A * 10/1973 Hussey et al. ..... 60/39.463
4,134,606 A * 1/1979 Menti, Jr. ..... 285/21.1
4,435,153 A 3/1984 Hashimoto et al.
4,498,288 A 2/1985 Vogt
6,201,029 B1 3/2001 Waycuilis
6,918,243 B2 * 7/2005 Fisher ..... 60/211
7,513,116 B2 * 4/2009 Hebert et al. ..... 60/748
2007/0275337 A1 11/2007 Heilos et al.
2009/0049838 A1 * 2/2009 Oskin et al. ..... 60/734
2010/0139238 A1 * 6/2010 Hall et al. ..... 60/39.463
2010/0180600 A1 * 7/2010 Lacy et al. ..... 60/740

FOREIGN PATENT DOCUMENTS

EP 0 310 327 B1 9/1988

* cited by examiner

*Primary Examiner* — Louis Casaregola
*Assistant Examiner* — Phutthiwat Wongwian
(74) *Attorney, Agent, or Firm* — Nixon & Vanderhye P.C.

(57) ABSTRACT

A fuel nozzle for a turbine engine is configured to deliver a large volume of a fuel which has a relatively low amount of energy per unit volume. The fuel nozzle includes a fuel swirler plate having fuel delivery apertures which are angled with respect to the flat surfaces of the swirler plate. A nozzle cap covers the end of the fuel nozzle to create a swirl chamber at the outlet end. The nozzle cap may include a plurality of air inlet apertures to allow the air to enter the swirl chamber.

20 Claims, 8 Drawing Sheets

HIGH VOLUME FUEL NOZZLES FOR A TURBINE ENGINE

BACKGROUND OF THE INVENTION

The invention relates to fuel nozzles which are used in turbine engines.

Turbine engines which are used in electrical power generating plants typically burn a combustible fuel. Combustion takes place in a plurality of combustors which are arranged around the exterior periphery of the turbine engine. Compressed air from the compressor section of the turbine engine is delivered into the combustors. Fuel nozzles located within the combustors inject the fuel into the compressed air and the fuel and air is mixed. The fuel-air mixture is then ignited to create hot combustion gases which are then routed to the turbine section of the engine.

Various different fuels can be used in turbine engines. Some common fuels include natural gas and various liquid fuels such as diesel. The fuel nozzles are shaped to deliver appropriate amounts of fuel into the combustors such that a proper fuel-air ratio is maintained, which leads to substantially complete combustion, and therefore high efficiency.

BRIEF DESCRIPTION OF THE INVENTION

A fuel nozzle for a turbine engine that includes a generally cylindrical main body, and a disc-shaped fuel swirler plate mounted inside the cylindrical main body adjacent an outlet end of the main body. A plurality of fuel delivery apertures extend through the swirler plate, the fuel delivery apertures being angled with respect to the first and second flat surfaces of the swirler plate. The fuel nozzle also includes a nozzle cap attached to the outlet end of the main body, wherein a diameter of the nozzle cap is gradually reduced from a first end which is coupled to the main body to second end which forms an outlet, and wherein an outlet side of the fuel swirler plate and an interior sidewall of the nozzle cap define a swirl chamber.

DETAILED DESCRIPTION OF THE INVENTION

Figure 1A:
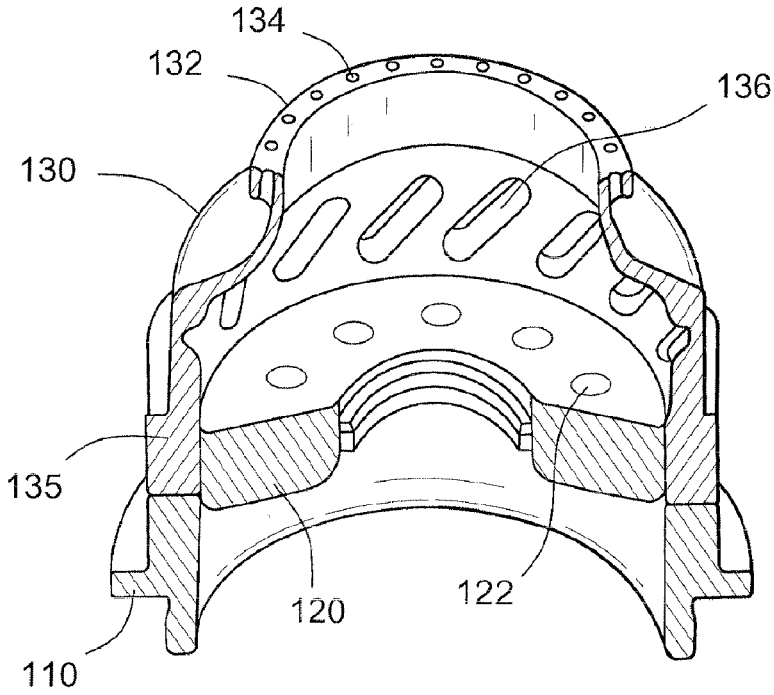
FIGS. 1A and 1B are cross sectional perspective views of a nozzle design including large round fuel delivery apertures.

As explained above, fuel nozzles for a turbine engine are configured to deliver appropriate amounts of fuel into a combustor so that an appropriate fuel-air mixture is obtained. The proper fuel-air mixture ratios ensure substantially complete combustion and result in high efficiency.

As the cost of the fuels has increased, there has been a renewed interest in using alternate, less expensive fuels in turbine engines. Alternate fuels which could be burned in turbine engine, but which are not typically used, include gasified coal, blast furnace gas from steel mills, landfill gases and gas created using other feed stocks. Typically these alternate fuels contain a considerably lower amount of energy per unit volume. For instance, some alternate gases only contain approximately ten percent of the heat energy, per unit volume, as one of the normal fuels such as natural gas or diesel. This means that to provide the same amount of heat energy, it is necessary to burn as much as ten times the volume of the alternate fuels as compared to one of the normal fuels.

Because fuel nozzles are currently designed to deliver a fuel which is high in heat energy, existing nozzle designs are not appropriate for the delivery of fuel at the higher flow rates that are required when burning of the alternate fuels. Current fuel nozzle designs simply cannot deliver a sufficient amount of one of the alternate fuels to properly run the turbine engine.

The fuel being delivered into the combustor of a turbine engine is delivered into the combustor at a pressure which is higher than the pressure within the combustor. As explained above, the combustors are filled with compressed air from the compressor section of the turbine. Thus, it is necessary to pressurize the fuel with a pump before it is delivered into the fuel nozzles. The fuel is typically delivered into the combustor at a pressure which is between 10 and 25 percent higher than the pressure of the air in the combustor. This ensures that the fuel exits the nozzle at a sufficiently high velocity to properly mix with the compressed air, and this also helps to ensure that the fuel is not ignited until it is a sufficient distance from the nozzle itself. Igniting the fuel only after it has moved some distance away from the nozzle helps to ensure that the fuel nozzle is not subjected to extremely high temperatures. It also prevents deterioration or destruction of the fuel nozzles which could occur if combustion of the fuel occurred within the nozzle itself.

The amount of energy used to pressurize the fuel before it is delivered to the nozzle basically represents an energy loss in the turbine. Because only a relatively low volume of the typical fuels are used in a turbine engine, the loss represented by the energy required to pressurize the fuel is not significant in the overall process. However, when an alternate fuel is used, a much greater volume of the fuel must be delivered to the combustor. The amount of energy required to pressurize the much larger volume of the alternate fuel represents a much greater percentage energy loss.

Because of the energy losses involved in pressurizing a large of an alternate fuel, it is desirable to design a fuel nozzle for the alternate fuels such that the fuel nozzle itself causes as little of a pressure loss as possible. This, in turn, lowers the pressure to which the fuel must be raised before it is delivered into the nozzle, thereby lowering the energy loss involved in pressurizing the fuel.

FIGS. 1A-4B illustrate some alternate nozzle designs which are designed to deliver an alternate fuel to a turbine engine, the alternate fuel having a relatively low energy content per unit volume. These fuel nozzle designs are capable of delivering a relatively high volume of the alternate fuel into the combustor of a turbine engine, to thereby accommodate the high volume needs when alternate fuels are used.

Figure 1B:
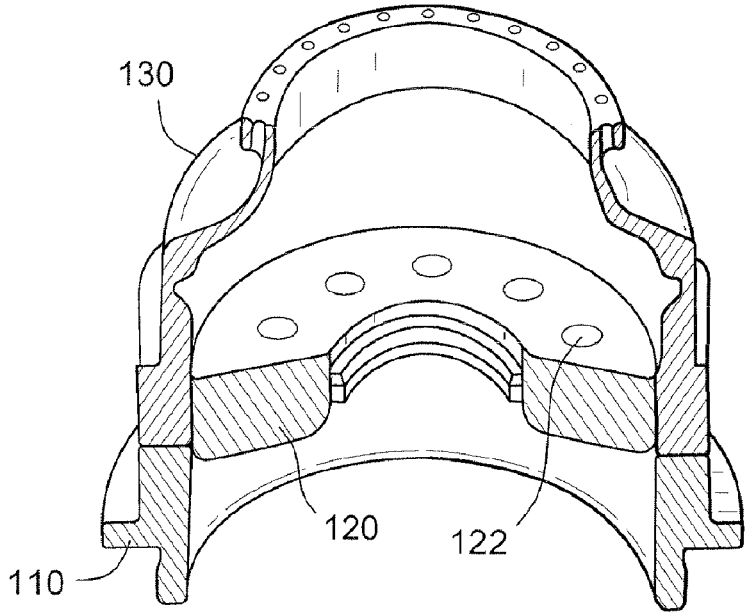

FIGS. 1A and 1B illustrate a first type of nozzle which includes a generally cylindrical main body portion 110, and a nozzle cap 130 mounted on the outlet end of the main body 110. A disc-shaped fuel swirler plate 120 is mounted inside the cylindrical main body 110 adjacent the outlet end of the main body. A plurality of fuel delivery apertures 122 extend through the swirler plate.

Figure 8:
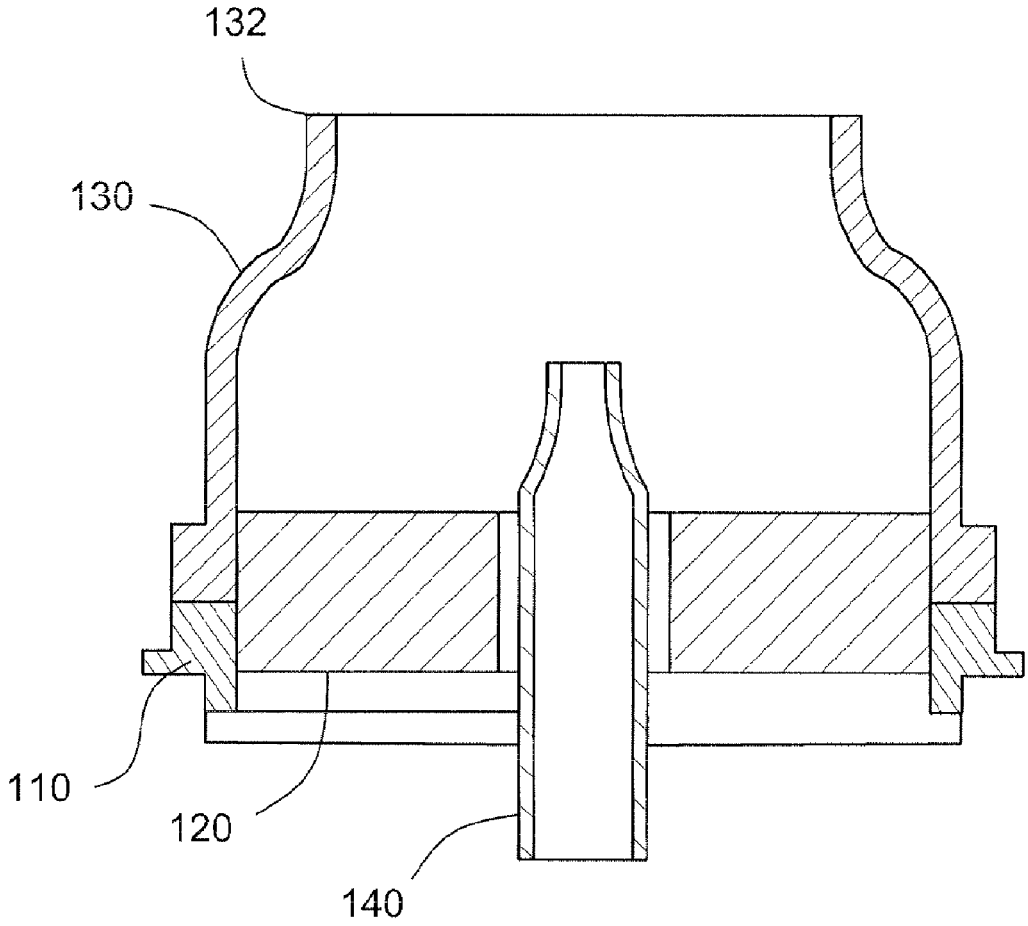
FIG. 8 is a cross sectional view illustrating a fuel nozzle design with a pilot or starter fuel nozzle.

The final installed configuration of a fuel nozzle would include a pilot or starter nozzle, as illustrated in FIG. 8. As shown therein, a pilot or starter nozzle 140 would be installed in the center of the swirler plate 120. The starter nozzle would be used to deliver a more traditional fuel, having a greater energy per unit volume. The starter fuel would be used during startup of the turbine, where use of only the alternate fuel would make it difficult to start the turbine. Once the turbine is up to speed, the flow of the starter fuel would be shut off, and only the alternate fuel would be used. In any event, the center of the swirler plate would typically be blocked with pilot nozzle.

The fuel delivery apertures 122 in FIGS. 1A and 1B are large round holes. However, the large round holes 122 pass through the disc-shaped fuel swirler plate 120 at an angle. As a result, fuel delivered through the fuel delivery apertures 122 tends to move in a rotational fashion as it exits the fuel delivery apertures 122 in the disc-shaped fuel swirler plate 120.

In the nozzle designs illustrated in FIGS. 1A and 1B, a swirl chamber 135 is formed between the outlet end of the disc-shaped fuel swirler plate 120 and the interior side wall of the nozzle cap 130. Fuel passing through the fuel delivery apertures 122 will tend to swirl around the swirl chamber 135.

In the embodiment illustrated in FIG. 1A, a plurality of air inlet apertures 136 are formed in the sidewall of the nozzle cap 130. The air inlet apertures 136 allow air from outside the fuel nozzle to enter the swirl chamber 135. The air entering through the inlet apertures 136 also tends to impart a swirling motion within the swirl chamber, and the air will mix with the fuel exiting the fuel delivery apertures 122 in the fuel swirler plate 120. The fuel-air mixture will then exit the nozzle at the outlet end 132 of the nozzle cap 130. The embodiment illustrated in FIG. 1B does not include the air inlet apertures.

Figure 2A:
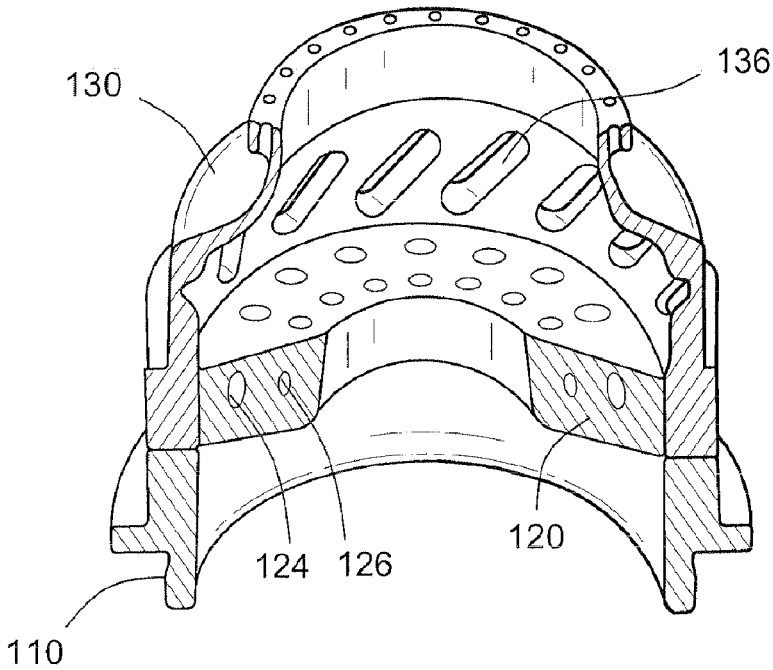
FIGS. 2A and 2B are cross sectional perspective views of a nozzle design having small, round fuel delivery apertures.

The embodiments in FIGS. 2A and 1B also include effusion cooling holes 134 in the top circular edge 132 of the nozzle cap 130. These effusion cooling holes 134 allow air to pass through the material of the nozzle cap to help cool the nozzle cap.

Figure 2B:
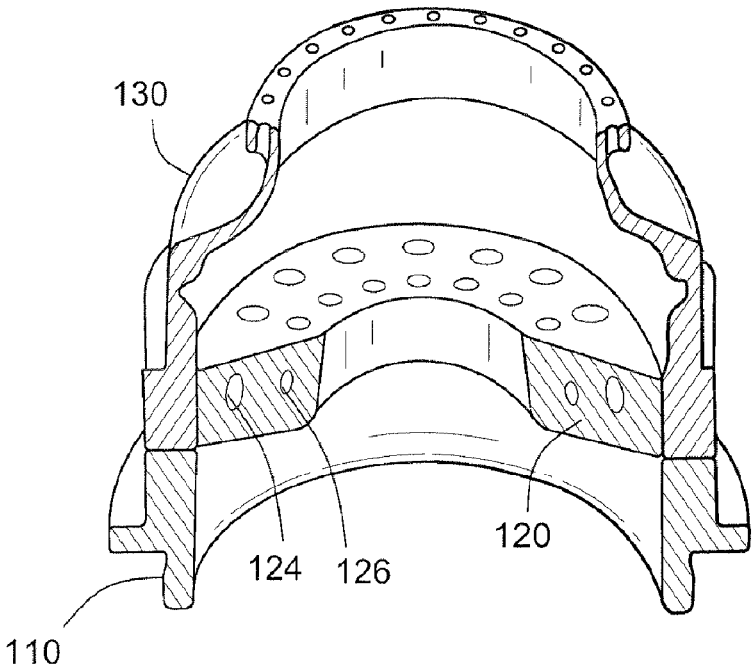

FIGS. 2A and 2B illustrate an alternate nozzle design. In this embodiment, the fuel delivery apertures 124, 126 are formed of smaller diameter holes which are arranged in two concentric rings around the disc-shaped fuel swirler plate 120. The two concentric rings of fuel delivery apertures 124, 126 could have the same diameter, or a different diameter. In some embodiments, the fuel delivery apertures 124, 126 would also pass through the fuel swirler plate 120 at an angle, so that the fuel exiting the fuel delivery apertures 124, 126 would then to move in a rotational fashion inside the nozzle cap 130. Although the embodiment in FIGS. 2A and 2B include two concentric rings of the fuel delivery apertures, in alternate embodiments different numbers of the concentric rings of fuel delivery apertures could be formed. In still other embodiments, circular hole-shaped fuel delivery apertures could be arranged in the swirler plate 120 in some other type of pattern.

Figure 3A:
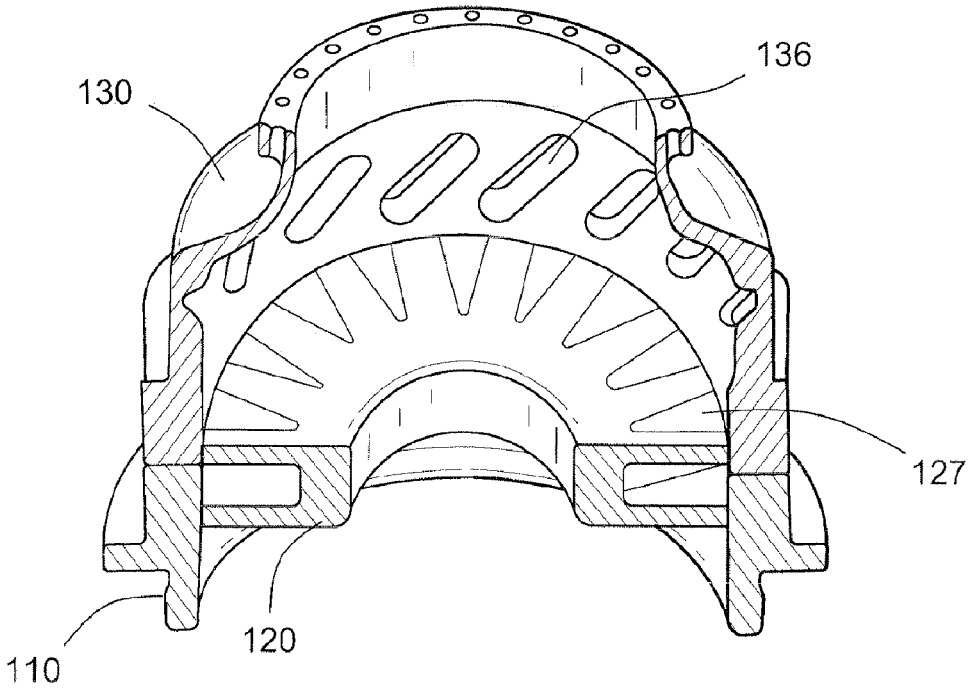
FIGS. 3A and 3B are cross sectional perspective views of a nozzle design having helical fuel delivery apertures.
Figure 3B:
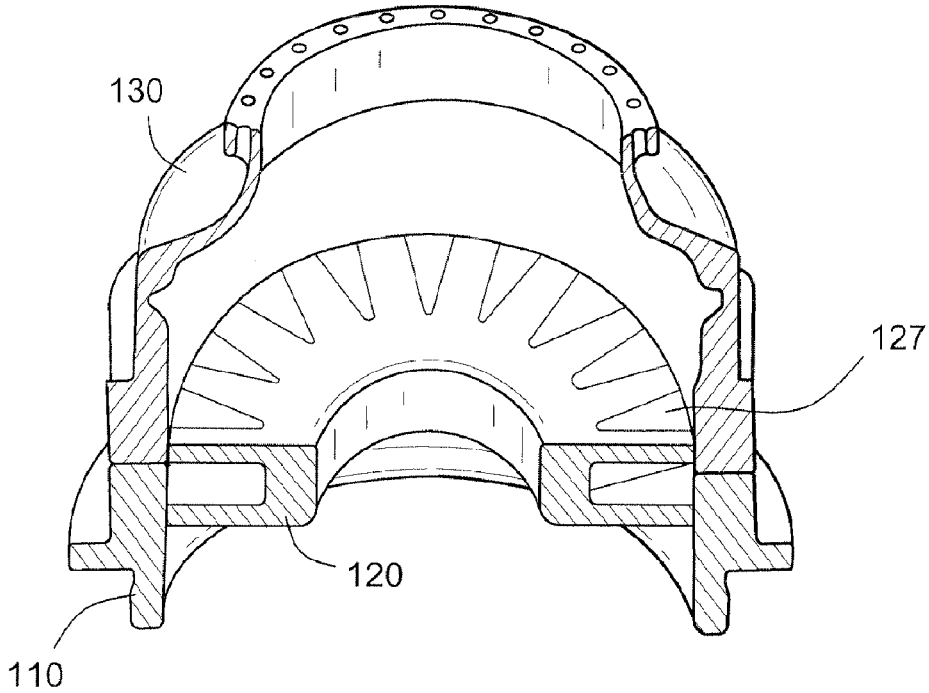

FIGS. 3A and 3B illustrate another alternate nozzle design. In this embodiment, the fuel delivery apertures 127 passing through the fuel swirler plate 120 are helical in nature. Here again, the helical fuel delivery apertures 127 are intended to cause the fuel exiting the swirler plate to rotate around inside the nozzle cap 130.

Figure 4A:
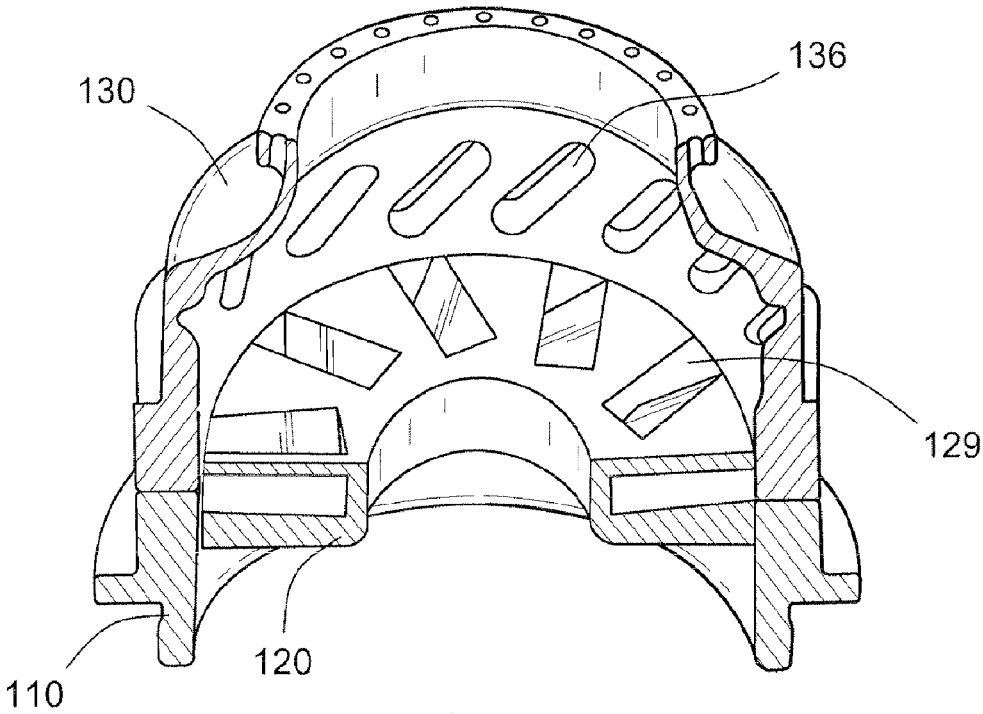
FIGS. 4A and 4B are cross sectional perspective views of a fuel nozzle having slot-shaped fuel delivery apertures.
Figure 4B:
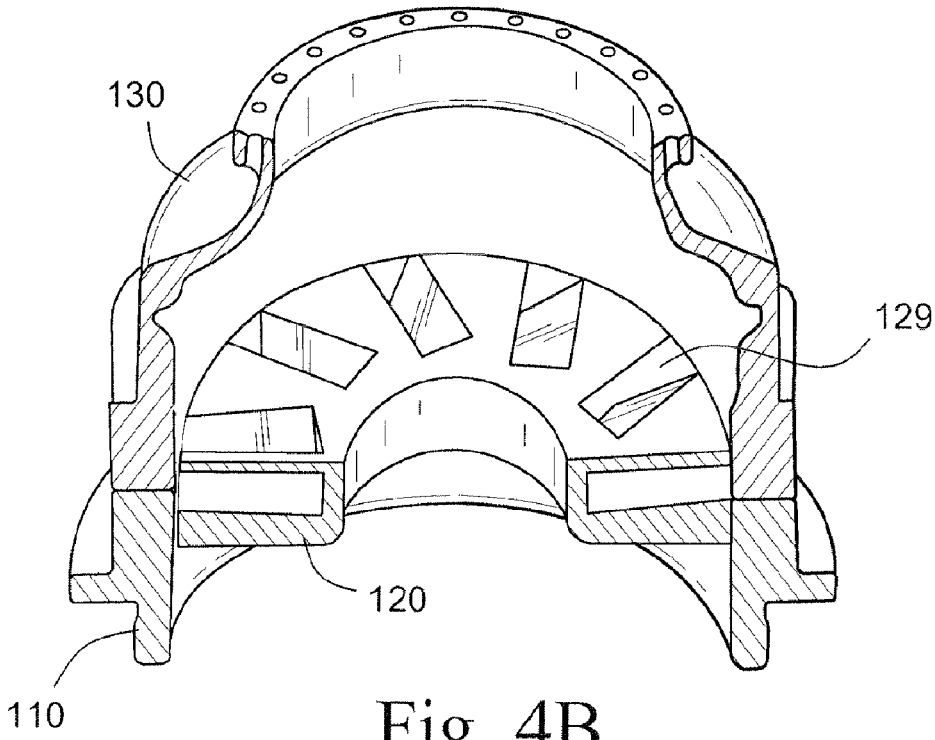

FIGS. 4A and 4B illustrate other alternate embodiments. In these embodiments, the fuel delivery apertures 129 are slots having a rectangular cross-section which extend through the fuel swirler plate 120.

Figure 5A:
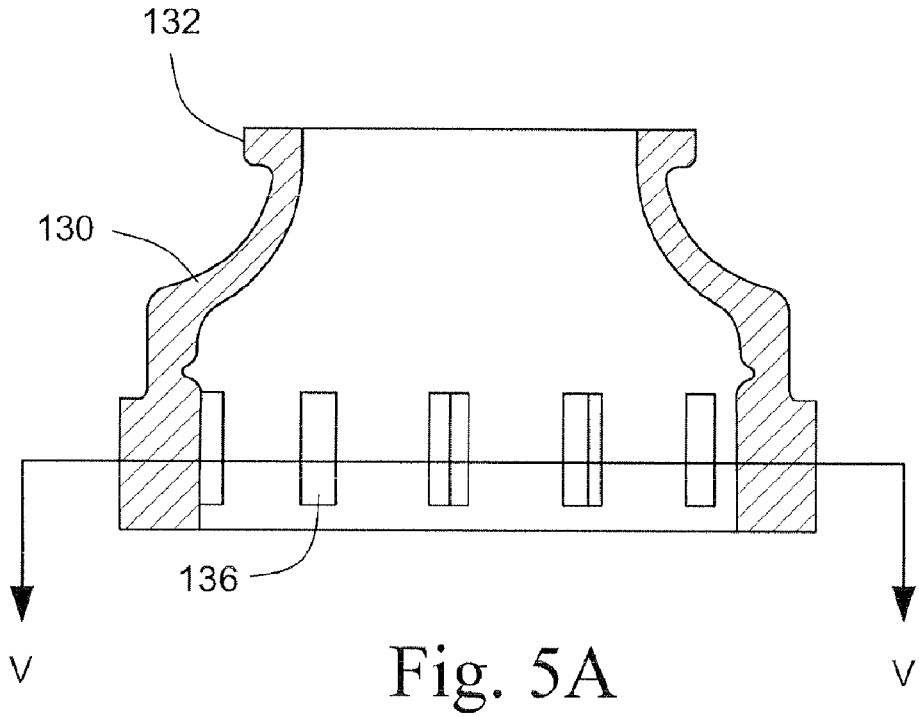
FIGS. 5A and 5B are cross sectional views of a nozzle cap.
Figure 5B:
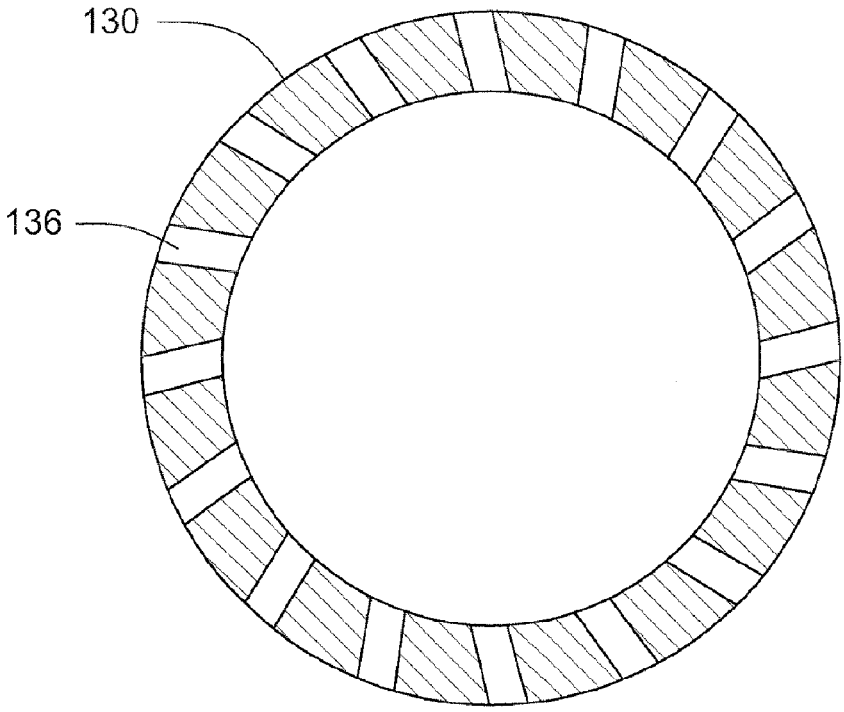

FIGS. 5A and 5B illustrate a nozzle cap design which includes a plurality of air inlet apertures 136. As shown in FIG. 5B, the air inlet apertures 136 pass through the side wall of the nozzle cap 130 at an angle. This helps to impart a swirling motion to the fuel-air mixture in the swirl chamber. In the embodiment illustrated in FIGS. 5A and 5B, a longitudinal axis of the elongated air inlet apertures 136 is oriented substantially parallel to a central longitudinal axis of the nozzle cap itself.

Figure 6A:
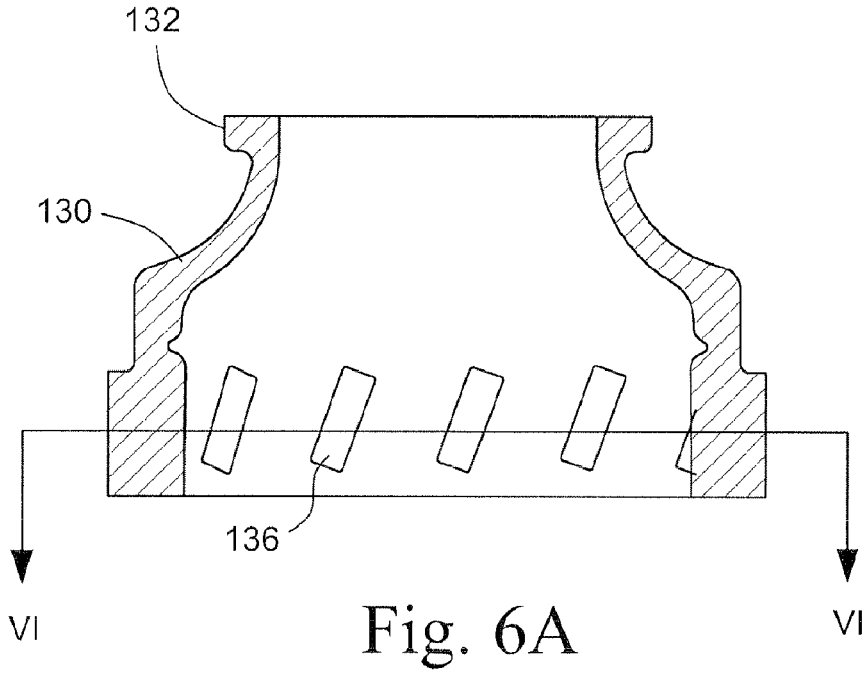
FIGS. 6A and 6B are cross sectional views of an alternate nozzle cap design.
Figure 6B:
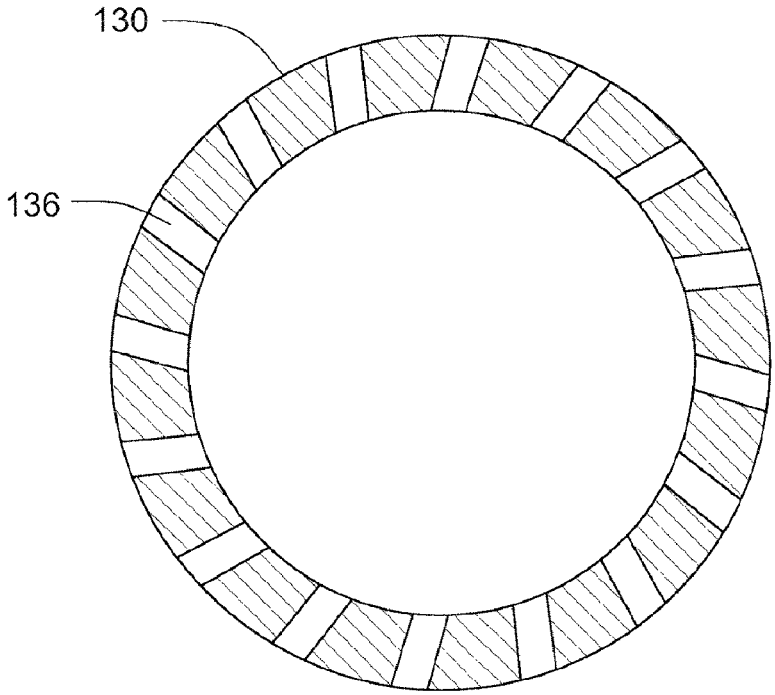

In an alternate design, as illustrated in FIGS. 6A and 6B, elongated air inlet apertures are angled with respect to the central longitudinal axis of the nozzle cap itself. However, the air inlet apertures 136 are still angled as they pass through the side wall of the nozzle cap 130. As explained above, this helps impart a swirling motion to the fuel air mixture inside the swirl chamber.

Figure 7A:
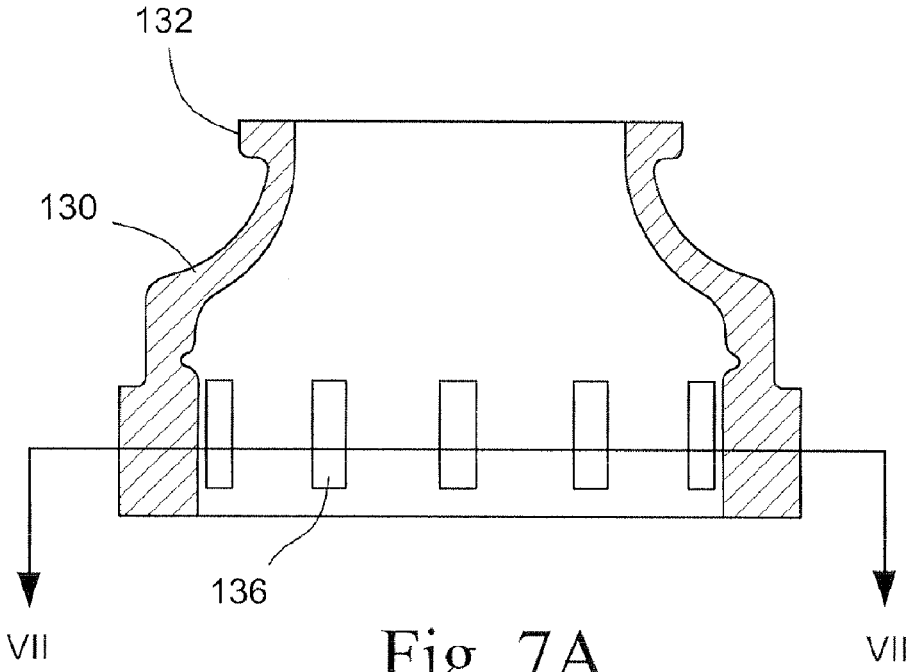
FIGS. 7A and 7B are cross sectional views of another alternate nozzle cap design.
Figure 7B:
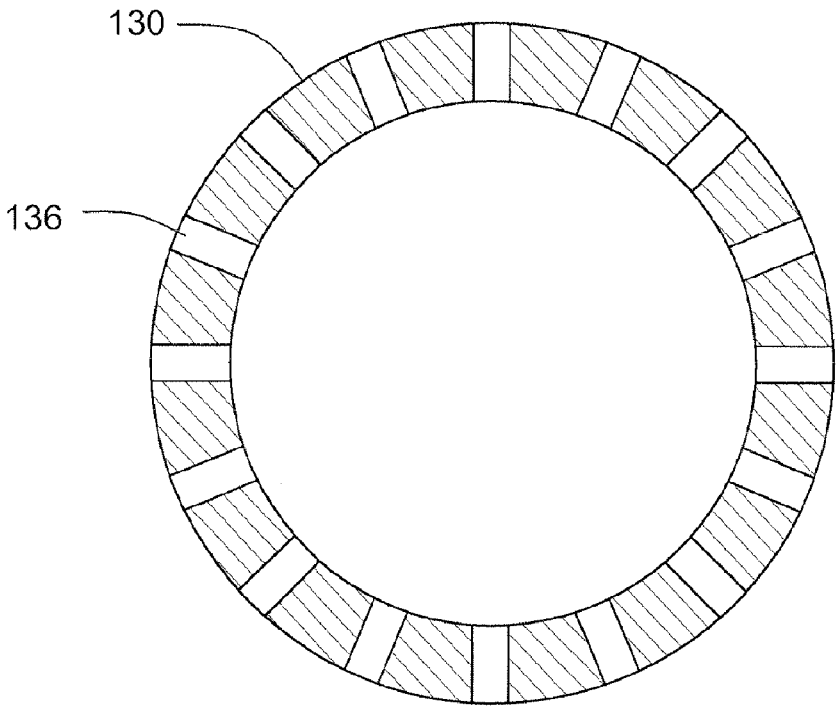

FIGS. 7A and 7B illustrate another alternate design similar to the one shown in FIGS. 5A and 5B. However, in this embodiment, the elongated air inlet apertures pass straight through the side wall of the nozzle cap in a radial direction. In still other embodiments, the air inlet apertures may pass through the side wall of the nozzle cap in a radial direction, as illustrated in FIG. 7B, but the apertures may be angled with respect to the central longitudinal axis, as illustrated in FIG. 6A.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel nozzle for a turbine engine, comprising:

a generally cylindrical main body;

a disc-shaped fuel swirler plate mounted inside the cylindrical main body adjacent an outlet end of the main body, wherein a plurality of fuel delivery apertures extend through the swirler plate, the fuel delivery apertures being angled with respect to the first and second flat surfaces of the swirler plate, and wherein a circular aperture is formed in the center of the disc-shaped fuel swirler plate;

a pilot nozzle mounted inside the circular apreture; and a nozzle cap attached to the outlet end of the main body, wherein a diameter of the nozzle cap is gradually reduced from a first end which is coupled to the main body to second end which forms an outlet, and wherein an outlet side of the fuel swirler plate and an interior sidewall of the nozzle cap define a swirl chamber.

2. The fuel nozzle of claim 1, wherein the angled fuel delivery apertures impart a swirling motion to fuel exiting the swirler plate and entering the swirl chamber.

3. The fuel nozzle of claim 1, wherein the fuel delivery apertures comprise a single ring of apertures formed around a center of the disc-shaped fuel swirler plate.

4. The fuel nozzle of claim 3, wherein the fuel delivery apertures have a circular cross-sectional shape.

5. The fuel nozzle of claim 3, wherein the fuel delivery apertures have a rectilinear cross-sectional shape.

6. The fuel nozzle of claim 1, wherein the fuel delivery apertures comprise a plurality of rings of apertures formed around a center of the disc-shaped fuel swirler plate.

7. The fuel nozzle of claim 6, wherein the fuel delivery apertures have a circular a cross-sectional shape.

8. The fuel nozzle of claim 1, wherein the fuel delivery apertures have a circular a cross-sectional shape.

9. The fuel nozzle of claim 1, wherein the fuel delivery apertures have a rectilinear cross-sectional shape.

10. The fuel nozzle of claim 1, wherein the fuel delivery apertures extend through the disc-shaped fuel swirler plate in a helical fashion.

11. The fuel nozzle of claim 1, further comprising a plurality of air inlet apertures formed through a sidewall of the nozzle cap, wherein the air inlet apertures allow air from outside the nozzle cap to enter the swirl chamber.

12. The fuel nozzle of claim 11, wherein the air inlet apertures pass through the sidewall of the nozzle cap at an angle with respect to the inner and outer sides of the sidewall to thereby impart a swirling motion to air entering the swirl chamber through the air inlet apertures.

13. The fuel nozzle of claim 11, wherein the air inlet apertures are elongated holes formed in the sidewall of the nozzle cap.

14. The fuel nozzle of claim 13, wherein a central longitudinal axis of the air inlet apertures is substantially parallel to a central longitudinal axis of the nozzle cap.

15. The fuel nozzle of claim 13, wherein a central longitudinal axis of the air inlet apertures is angled with respect to a central longitudinal axis of the nozzle cap.

16. A fuel nozzle for a turbine engine, comprising:

a generally cylindrical main body;

a disc-shaped fuel swirler plate mounted inside the cylindrical main body adjacent an outlet end of the main body, wherein a plurality of fuel delivery apertures extend through the swirler plate, the fuel delivery apertures being angled with respect to the first and second flat surfaces of the swirler plate; and a nozzle cap attached to the outlet end of the main body, wherein a diameter of the nozzle cap is gradually reduced from a first end which is coupled to the main body to a second end which forms an outlet, wherein an outlet side of the fuel swirler plate and an interior sidewall of the nozzle cap define a swirl chamber, and wherein a plurality of air inlet apertures are formed through a sidewall of the nozzle cap, the air inlet apertures allowing air from outside the nozzle cap to enter the swirl chamber.

17. The fuel nozzle of claim 16, wherein the air inlet apertures pass through the sidewall of the nozzle cap at an angle with respect to the inner and outer sides of the sidewall to thereby impart a swirling motion to air entering the swirl chamber through the air inlet apertures.

18. The fuel nozzle of claim 17, wherein the air inlet apertures are elongated holes formed in the sidewall of the nozzle cap.

19. The fuel nozzle of claim 18, wherein a central longitudinal axis of the air inlel apertures is substantially parallel to a central longitudinal axis of the nozzle cap.

20. The fuel nozzle of claim 18, wherein a central longitudinal axis of the air inlet apertures is angled with respect to a central longitudinal axis of the nozzle cap.

* * * * *

UNITED STATES PATENT AND TRADEMARK OFFICE

CERTIFICATE OF CORRECTION

PATENT NO. : 8,161,751 B2
APPLICATION NO. : 12/433236
DATED : April 24, 2012
INVENTOR(S) : Hall It is certified that error appears in the above-identified patent and that said Letters Patent is hereby corrected as shown below:

In the Claims:

In Claim 1 at column 4, line 40, delete “to the first and second flat” and insert --to first and second flat--

In Claim 1 at column 4, line 44, delete “apreture” and insert --aperture--

In Claim 7 at column 4, line 65, delete “a circular a” and insert --a circular--

In Claim 19 at column 6, line 23, delete “inlel apertures” and insert --inlet apertures--

Signed and Sealed this
Nineteenth Day of June, 2012

David J. Kappos

David J. Kappos
*Director of the United States Patent and Trademark Office*